US011668125B2

(12) United States Patent
Patil et al.

(10) Patent No.: US 11,668,125 B2
(45) Date of Patent: Jun. 6, 2023

(54) RESILIENT RETAINER FOR A HINGE ASSEMBLY OF AN APPLIANCE DOOR PANEL

(71) Applicant: WHIRLPOOL CORPORATION, Benton Harbor, MI (US)

(72) Inventors: Vasudeo N. Patil, Pune (IN); David Walter, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/536,742

(22) Filed: Nov. 29, 2021

(65) Prior Publication Data

US 2022/0081946 A1 Mar. 17, 2022

Related U.S. Application Data

(63) Continuation of application No. 16/729,610, filed on Dec. 30, 2019, now Pat. No. 11,214,998.

(51) Int. Cl.

| | |
|---|---|
| ***E05D 7/10*** | (2006.01) |
| ***E05D 3/02*** | (2006.01) |
| ***D06F 39/14*** | (2006.01) |

(52) U.S. Cl.

CPC ..... *E05D 7/1011* (2013.01); *D06F 39/14* (2013.01); *E05D 3/02* (2013.01); *E05D 7/1005* (2013.01); *E05D 7/1022* (2013.01); *E05D 2007/1027* (2013.01); *E05Y 2201/214* (2013.01); *E05Y 2201/48* (2013.01); *E05Y 2800/46* (2013.01); *E05Y 2800/676* (2013.01); *E05Y 2900/30* (2013.01); *E05Y 2900/312* (2013.01); *Y10T 16/5355* (2015.01); *Y10T 16/5357* (2015.01); *Y10T 16/53607* (2015.01); *Y10T 16/536075* (2015.01)

(58) Field of Classification Search

CPC ... D06F 39/14; E05F 3/20; E05D 3/02; E05D 7/1011; E05D 2007/1027; E05D 7/1022; E05D 7/1005; E05Y 2900/312; E05Y 2800/676; E05Y 2800/46; E05Y 2201/48; E05Y 2900/30; E05Y 2201/214; Y10T 16/5355; Y10T 16/5357; Y10T 16/53607; Y10T 16/536075

See application file for complete search history.

(56) References Cited

U.S. PATENT DOCUMENTS

| | | | |
|---|---|---|---|
| 1,904,110 | A | 4/1933 | Willmann |
| 3,921,254 | A | 11/1975 | Foster, Jr. et al. |
| 4,305,614 | A | 12/1981 | Holka et al. |
| 5,430,253 | A | 7/1995 | Pratt |
| 6,292,980 | B1 | 9/2001 | Yi et al. |
| 6,295,358 | B1 | 9/2001 | Kubota |

(Continued)

FOREIGN PATENT DOCUMENTS

| | | |
|---|---|---|
| BR | 102013028409 | 9/2015 |
| GB | 2391257 | 2/2004 |
| JP | 2003065321 | 3/2003 |

*Primary Examiner* — Hanh V Tran

(74) *Attorney, Agent, or Firm* — Price Heneveld LLP

(57) ABSTRACT

An operable panel for an appliance includes a top panel that defines a hinge receptacle. A lid includes a hinge housing. A hinge is disposed within the hinge housing and extends between the lid and the top panel. A retainer includes a cap and a resilient portion. The retainer partially surrounds the hinge and the cap encloses the hinge housing. The resilient portion of the retainer biases the hinge toward the cap and the hinge receptacle.

19 Claims, 8 Drawing Sheets

(56) References Cited

U.S. PATENT DOCUMENTS

| | | | |
|---|---|---|---|
| 6,665,984 | B2 | 12/2003 | Bienick et al. |
| 8,161,603 | B2 | 4/2012 | Park et al. |
| 9,464,376 | B2 | 10/2016 | Kim |
| 10,604,881 | B1 | 3/2020 | Allen et al. |
| 10,947,765 | B2 | 3/2021 | Wu et al. |
| 2001/0011405 | A1 | 8/2001 | Minami |
| 2004/0160149 | A1 | 8/2004 | Chen |
| 2005/0078818 | A1 | 4/2005 | Bae |
| 2005/0091794 | A1 | 5/2005 | Kang |
| 2006/0086155 | A1 | 4/2006 | Kim et al. |
| 2011/0018408 | A1 | 1/2011 | Cho et al. |
| 2011/0041285 | A1 | 2/2011 | Hong |
| 2011/0050060 | A1 | 3/2011 | Kim et al. |
| 2011/0062837 | A1 | 3/2011 | Kim et al. |
| 2011/0121694 | A1 | 5/2011 | Kim et al. |
| 2011/0154611 | A1 | 6/2011 | Zhou et al. |
| 2013/0111706 | A1 | 5/2013 | Anderson et al. |
| 2014/0125210 | A1 | 5/2014 | Park et al. |
| 2014/0251741 | A1 | 9/2014 | Brera |
| 2015/0204128 | A1 | 7/2015 | Bacchetti |
| 2015/0252508 | A1 | 9/2015 | Kim et al. |
| 2017/0191210 | A1 | 7/2017 | Jung et al. |
| 2018/0080160 | A1 | 3/2018 | Mora |
| 2018/0179690 | A1 | 6/2018 | Cheon et al. |
| 2018/0187363 | A1 | 7/2018 | Jang et al. |
| 2018/0245387 | A1 | 8/2018 | Suzuki |
| 2018/0266156 | A1 | 9/2018 | Mora et al. |
| 2018/0361548 | A1 | 12/2018 | Vandevelde |
| 2020/0115843 | A1 | 4/2020 | Milost et al. |

RESILIENT RETAINER FOR A HINGE ASSEMBLY OF AN APPLIANCE DOOR PANEL

CROSS-REFERENCE TO RELATED APPLICATION

The present application is a continuation of U.S. patent application Ser. No. 16/729,610 filed Dec. 30, 2019, now U.S. Pat. No. 11,214,998, entitled RESILIENT RETAINER FOR A HINGE ASSEMBLY OF AN APPLIANCE DOOR PANEL, the entire disclosure of which is hereby incorporated herein by reference.

BACKGROUND OF THE DISCLOSURE

The present disclosure generally relates to appliances, and more specifically, to a resilient retainer that is incorporated within a hinge assembly for the operable panel of an appliance.

SUMMARY OF THE DISCLOSURE

According to one aspect of the present disclosure, an appliance includes a cabinet having an interior processing chamber. A lid is rotationally operable relative to the cabinet between open and closed positions. The lid includes a hinge housing. A hinge assembly extends between the lid and the cabinet. The hinge assembly includes a hinge member disposed within the hinge housing and having a flange that engages the lid. A pin extends outward from the hinge housing to engage the cabinet. A retainer occupies the hinge housing to rotationally secure the hinge member therein. The retainer includes a cap that encloses the hinge housing and also includes a resilient portion that biases the pin through the cap.

According to another aspect of the present disclosure, an operable panel for an appliance includes a top panel that defines a hinge receptacle. A lid includes a hinge housing. A hinge is disposed within the hinge housing and extends between the lid and the top panel. A retainer includes a cap and a resilient portion. The retainer partially surrounds the hinge and the cap encloses the hinge housing. The resilient portion of the retainer biases the hinge toward the cap and the hinge receptacle.

According to yet another aspect of the present disclosure, a hinge assembly for an appliance includes a hinge disposed within a hinge housing of an operable panel. A retainer includes a cap that attaches to an outer aperture of the hinge housing to enclose the hinge housing. The retainer includes a resilient portion that is integrally formed with each of the cap and a body extending between the cap and the resilient portion. The cap engages a first side of the hinge and the resilient portion engages an opposing second side of the hinge. The resilient portion is compressed within the hinge housing and biasing the hinge toward the cap.

These and other features, advantages, and objects of the present disclosure will be further understood and appreciated by those skilled in the art by reference to the following specification, claims, and appended drawings.

Figure 1:
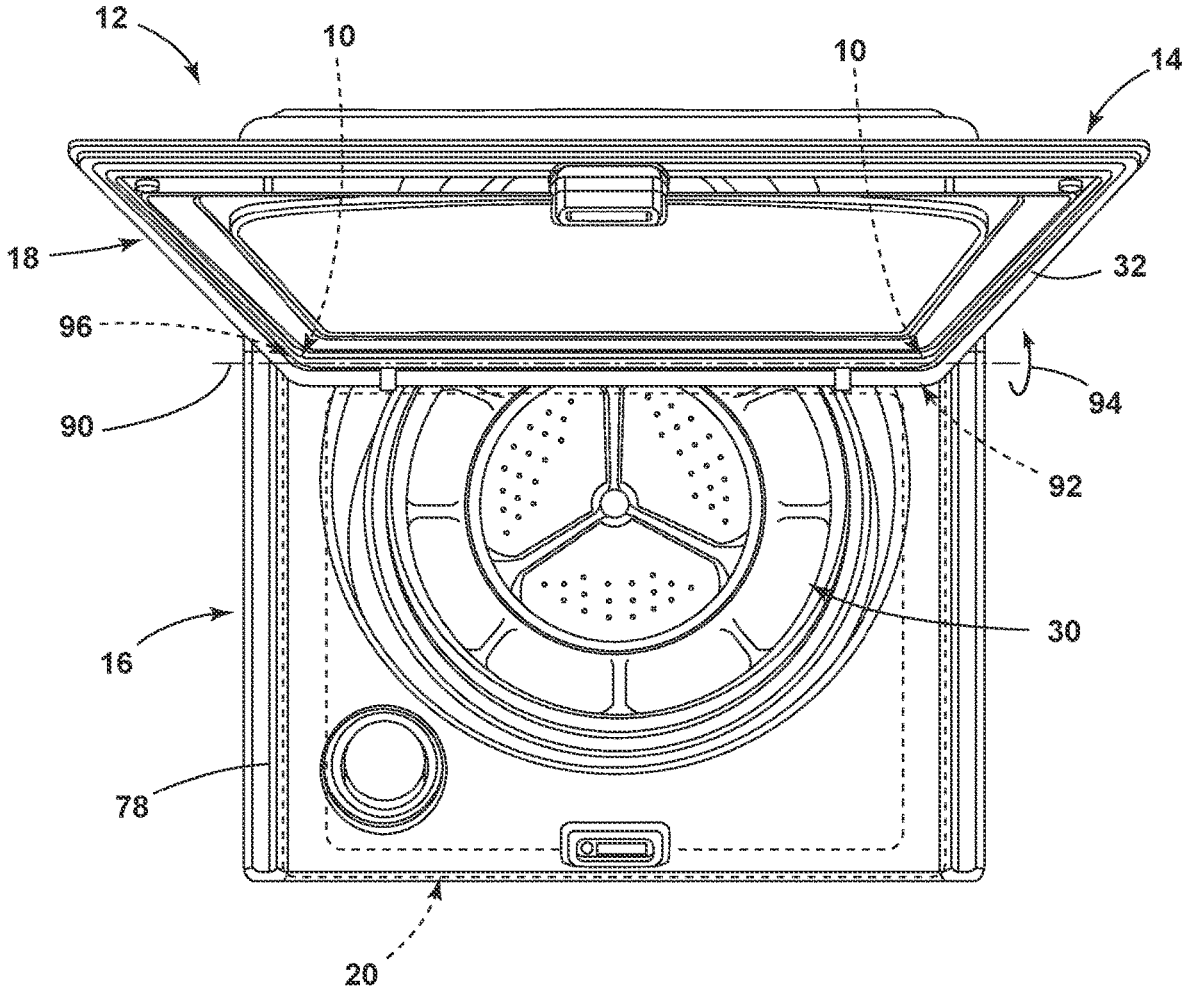
FIG. 1 is a top perspective view of a laundry appliance that incorporates an aspect of the hinge assembly, and showing the operable panel in the open position.

The components in the figures are not necessarily to scale, emphasis instead being placed upon illustrating the principles described herein.

DETAILED DESCRIPTION

The present illustrated embodiments reside primarily in combinations of method steps and apparatus components related to a hinge assembly for an operable panel for an appliance that includes a resilient retainer that secures the hinge within a hinge housing. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally refers to a hinge assembly that is incorporated within an appliance 12 for securing an operable panel 14 to a structural cabinet 16. The hinge assembly 10 is utilized for coupling the operable panel 14 to the structural cabinet 16, and also for providing a convenient installation mechanism for securing the operable panel 14. The hinge assembly 10 allows the operable panel 14 to rotate between open and closed positions 18, 20. The appliance 12 incorporating the aspect of the hinge assembly 10 described herein is typically a laundry appliance 12. It is contemplated that other appliances 12 can utilize an aspect of the hinge assembly 10. Such appliances 12 can include, but are not limited to, dishwashers, refrigerators, coolers, ovens, small appliances, countertop-type appliances, and other similar appliances that include an operable panel 14 that is configured to rotate about a hinge assembly 10.

According to various aspects of the device, the appliance 12 includes a cabinet 16 having an interior processing chamber 30. An operable panel 14, such as a lid 32, is rotationally operable relative to the cabinet 16 between open and closed positions 18, 20. The lid 32 includes a hinge housing 34. The hinge assembly 10 extends between the lid 32 and the cabinet 16. The hinge assembly 10 includes a hinge member 36 disposed within the hinge housing 34 and having a flange 38 that extends to fixedly engage a portion of the lid 32. A pin extends outward from the hinge member 36 and the hinge housing 34 to engage the cabinet 16. A retainer 42 occupies a portion of the hinge housing 34 to rotationally secure the hinge member 36 within the hinge housing 34. The retainer 42 includes a cap 44 that encloses the hinge housing 34 and also includes a resilient portion 46 that biases the pin through the cap 44 to engage the cabinet 16.

Referring again to FIGS. 1-7, the hinge housing 34 is typically a cavity defined within the lid 32 that slidably receives the hinge member 36 and the retainer 42. The hinge member 36 is positioned within the retainer 42 during installation of the hinge assembly 10 within the hinge housing 34. The hinge housing 34 includes various securing geometries 60 that receive portions of the retainer 42 as well as the flange 38 for the hinge member 36. These securing geometries 60 are configured to maintain the rotational position of the hinge member 36 within the hinge housing 34. These securing geometries 60 also cooperate with the retainer 42 and the hinge member 36 to provide additional structural integrity to the lid 32 during operation of the hinge assembly 10 for moving the lid 32 between the open and closed positions 18, 20.

As exemplified in FIGS. 2-13, the retainer 42 includes a body 70 that extends between the cap 44 and the resilient portion 46. In this manner, the body 70, cap 44 and the resilient portion 46 are typically formed as a single and unitary piece. Where the retainer 42 is a single and integral piece, the retainer 42 is a plastic member that is injection molded as a single integral piece to define the unitary construction of the retainer 42. The retainer 42 can include the resilient portion 46 that is defined by a plurality of undulating biasing formations 72. These undulating biasing formations 72 form a spring-type formation that occupies a portion of the hinge housing 34. In this manner, the resilient portion 46 of the retainer 42 is operable between an extended state 74 and a compressed state 76. In the compressed state 76, which is typically seen during installation of the lid 32 with a top panel 78 for the appliance 12, the hinge member 36 and the pin are biased at least partially into the retainer 42 and within the hinge housing 34. As will be described more fully below, in this compressed state 76, the pin 40 is retracted into the retainer 42 and the hinge housing 34 to allow the pin 40 to bypass portions of the top panel 78, or other portion of the cabinet 16, to be inserted into a hinge receptacle 124.

Figure 2:
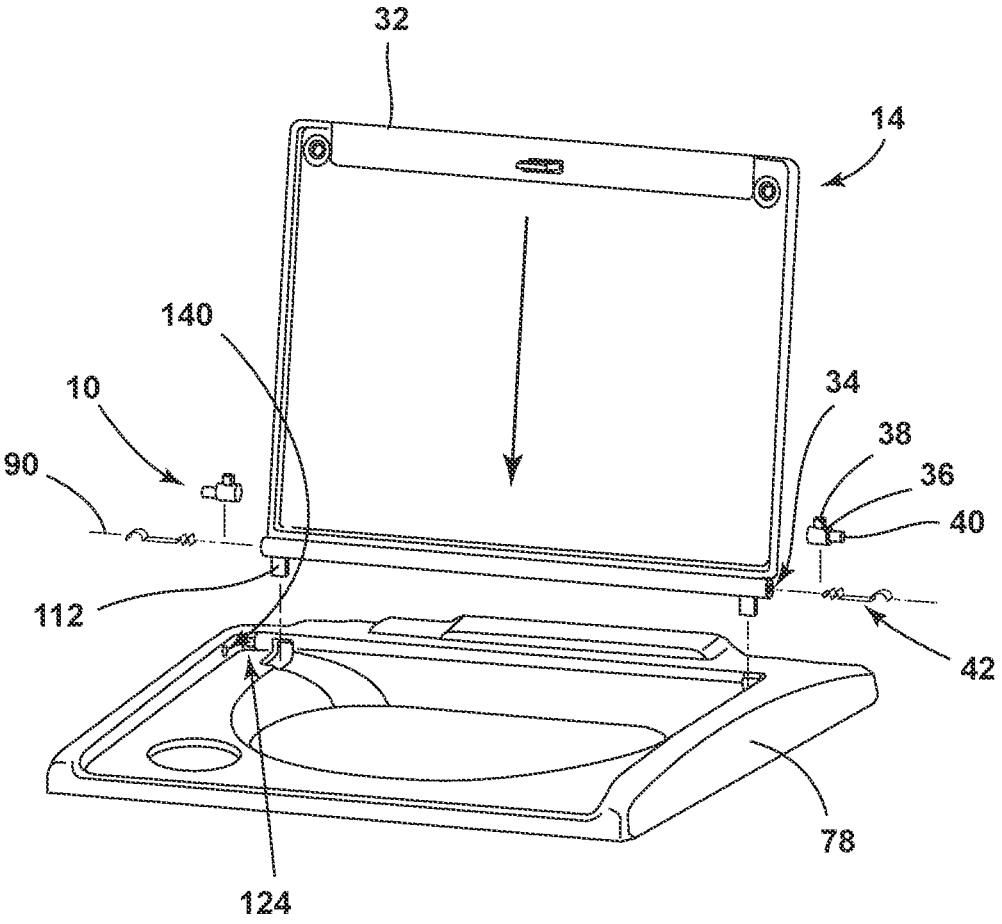
FIG. 2 is an exploded perspective view of the hinge assembly with respect to the operable panel and the top panel for the laundry appliance.
Figure 3:
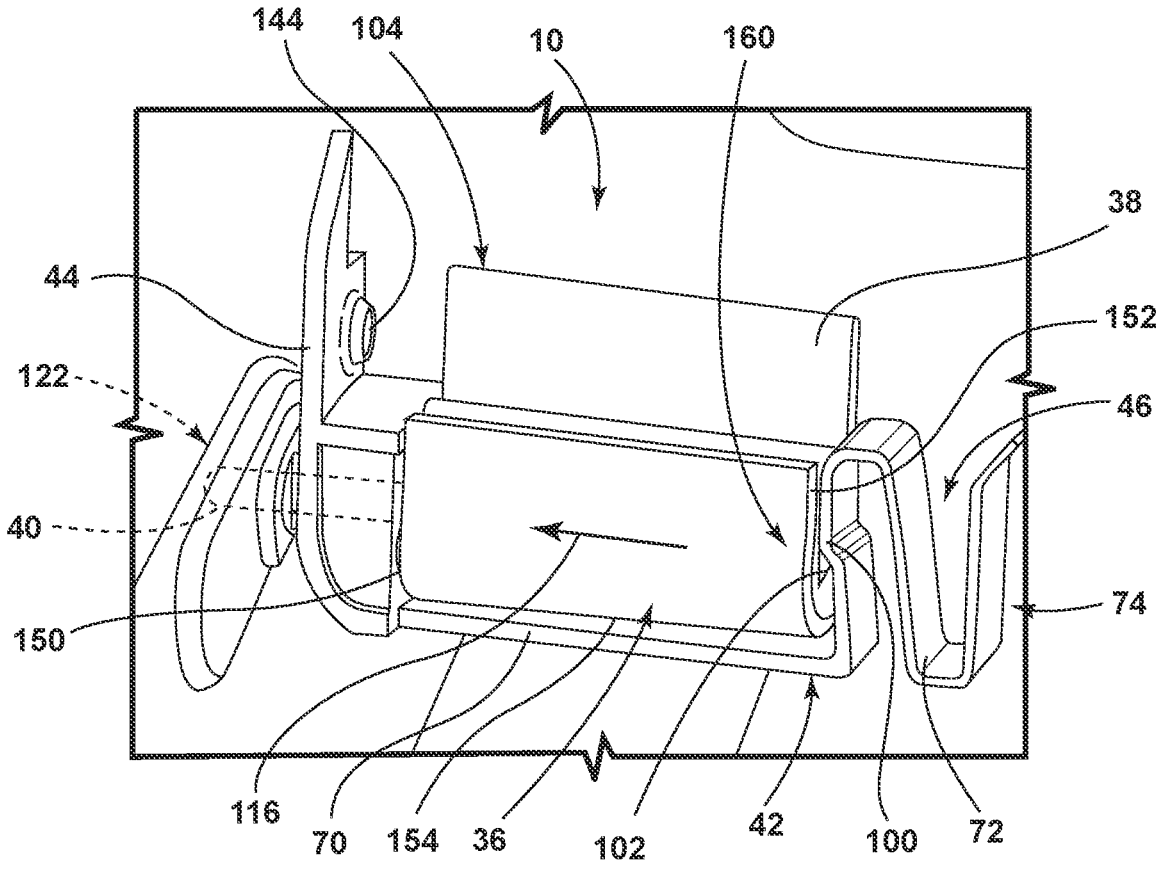
FIG. 3 is a perspective view of an aspect of a hinge assembly for the appliance.

As exemplified in FIGS. 1 and 2, the lid 32 or other operable panel 14 will include hinge assemblies 10 that are positioned on opposing sides of the operable panel 14. Each of these hinge assemblies 10 are separately retractable during installation of the operable panel 14 onto a portion of the lid 32.

As exemplified in FIGS. 1 and 2, the lid 32 is rotationally operable about the top panel 78 for the appliance 12 and about a horizontally-oriented rotational axis 90. In this configuration, the lid 32 is lifted from the closed position 20 to an open position 18. To assist in the opening of the lid 32 to the open position 18, the hinge assembly 10 can include a lift-assist mechanism 92 that provides an upward biasing force 94 for assisting a user in moving a lid 32 upward and to an open position 18. It is also contemplated that the hinge assembly 10 can include a damper 96 that operates to prevent the door from moving too quickly at least from the open position 18 to the closed position 20.

In particular, this damper 96 is incorporated to prevent the lid 32 from slamming against the top panel 78 when moving from the open position 18 to the closed position 20. In various aspects, the opposing hinge assemblies for the lid 32 can include the lift-assist mechanism 92 and a damper 96 within separate hinge assemblies 10, or within the same hinge assembly 10 for the lid 32. In each of these configurations, the retainer 42 having the resilient portion 46 can be utilized for retracting the pin 40 into the retainer 42 and into the hinge housing 34 for installing the lid 32 onto the top panel 78 for the appliance 12.

Referring now to FIGS. 3-9, the resilient portion 46 of the retainer 42 can include a retaining feature 100 that helps to secure the hinge member 36 against the body 70 of the retainer 42. This retaining feature 100 can include a tab or other similar retaining geometry that interacts with a securing portion 102 of the hinge member 36 to secure the hinge member 36 against the body 70 and between the cap 44 and the resilient portion 46. In this configuration, the retainer 42 can receive the hinge member 36 in a secured position 104, and this hinge assembly 10 can be installed within the hinge housing 34 as a single assembly. In this manner, the hinge assembly 10 can be slidably inserted into the hinge housing 34 to secure the hinge member 36 and the retainer 42 within the hinge housing 34. This configuration also assists in securing the flange 38 into a flange receptacle 106 of the hinge housing 34.

During operation of the lid 32, where the hinge assembly 10 includes the lift-assist mechanism 92 and/or the damper 96, the pin 40 can be rotationally secured within the hinge receptacle 124 of the top panel 78, or other portion of the cabinet 16. The flange 38 for the hinge member 36, similarly, is rotationally secure within the flange receptacle 106 for the lid 32. During operation of the lid 32 about the rotational axis 90 of the lid 32, the flange 38 rotates about the pin 40, and certain lift-assist features and damping features of the hinge assembly 10 can be utilized.

As discussed above, the retainer 42 serves to add structural integrity to the portions of the lid 32 or other operable panel 14 within and around the hinge housing 34. During operation of the lid 32 about the rotational axis 90 and between the open and closed positions 18, 20, certain stresses are exerted on the operable panel 14 as the flange 38 and the hinge member 36 rotate about the pin 40, which is rotationally secured to the structural cabinet 16. Biasing features and damping features contained within the hinge member 36 are operated, and certain rotational forces 110 are exerted by the hinge member 36, in a particular flange 38, against the lid 32. The retainer 42 assists in absorbing these rotational forces 110 to prevent deflection, and other unwanted bending within the operable panel 14.

Additionally, the operable panel 14 includes a blocking member 112 that holds the operable panel 14 in the open position 18. It is contemplated that the blocking member 112 engages a portion of the top panel 78 to hold the top panel 78 in the open position 18 and prevent over-rotation of the operable panel 14 beyond the open position 18. Certain abuse loads and similar rotational forces 110 may be exerted upon the operable panel 14 that may bias the operable panel 14 toward a position beyond the open position 18. These blocking members 112, engaged with the structural cabinet 16 in the open position 18, at least partially absorbs these abuse load rotational forces 110. It is contemplated that the retainer 42 disposed within the hinge housing 34 assists in absorbing some of these rotational forces 110. As discussed previously, the retainer 42 also adds structural integrity to the operable panel 14 at the hinge housing 34 to assist the operable panel 14 in absorbing the rotational forces 110 experienced by the operable panel 14 in the open position 18.

Figure 8:
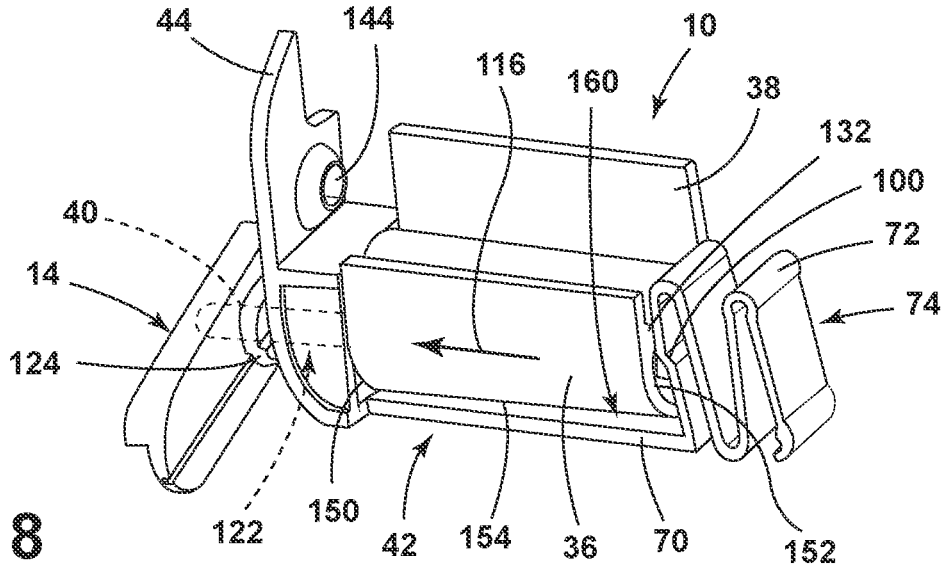
FIG. 8 is a side perspective view of an aspect of a hinge assembly for the operable panel for the appliance.
Figure 9:
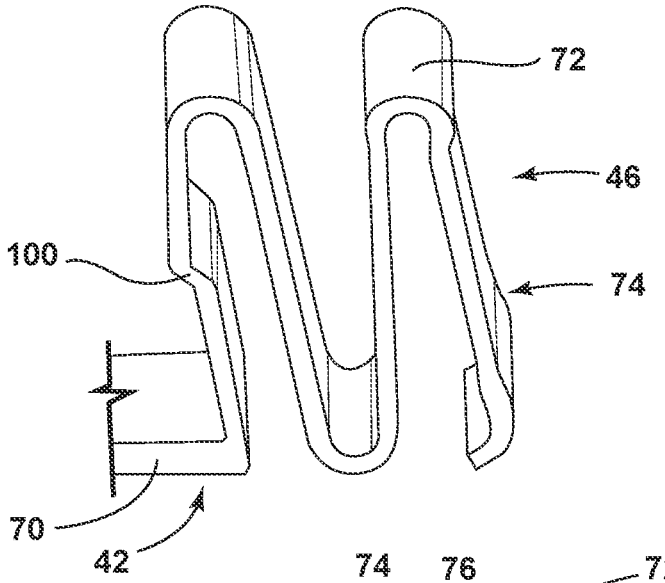
FIG. 9 is an enlarged perspective view of the resilient portion of an aspect of the resilient retainer.
Figure 10:
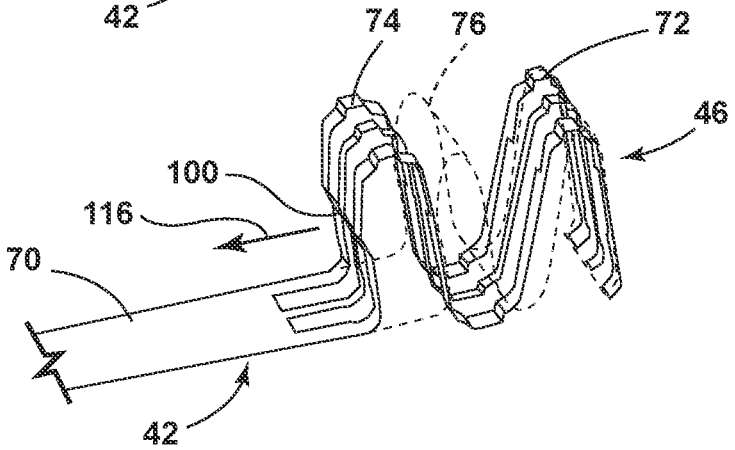
FIG. 10 is an enlarged perspective view of the resilient portion of an aspect of the resilient retainer.

As exemplified in FIGS. 8-10, the resilient portion 46 of the retainer 42 includes the undulating biasing formations 72 that can operate as a spring-type member for biasing the hinge member 36 in a generally outward direction 116. These undulating biasing formations 72 can be compressed to define the compressed state 76 during installation of the hinge assembly 10 and the remainder of the operable panel 14 onto the top panel 78 for the structural cabinet 16. These undulating biasing formations 72 can operate by deflecting toward one another to compress the various undulating biasing formations 72 to define the compressed state 76. It is also contemplated that portions of the undulating biasing formations 72 can slidably operate with respect to the hinge member 36. In such an embodiment, portions of the undulating biasing formations 72 can slidably operate toward the compressed state 76 and become generally aligned with the body 70 of the retainer 42. Such a configuration is typically utilized where the retainer 42 includes a metallic member or where a resilient metal or spring-type metal can be utilized for forming at least the body 70 and resilient portion 46 of the retainer 42.

Figure 4:
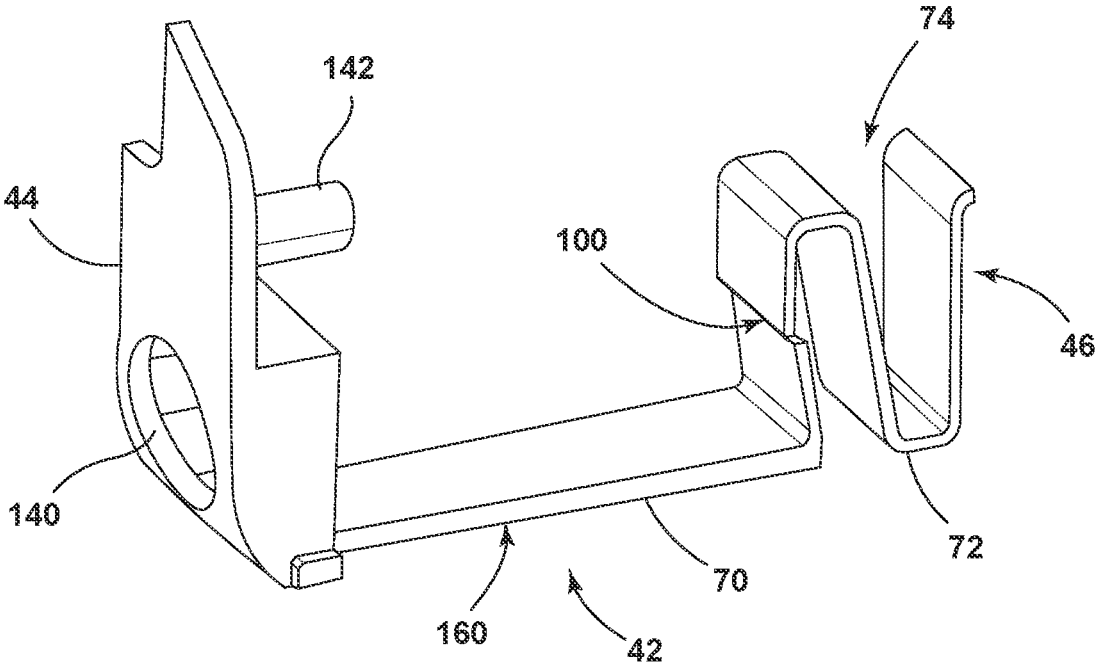
FIG. 4 is a perspective view of the resilient retainer of FIG. 3.
Figure 5:
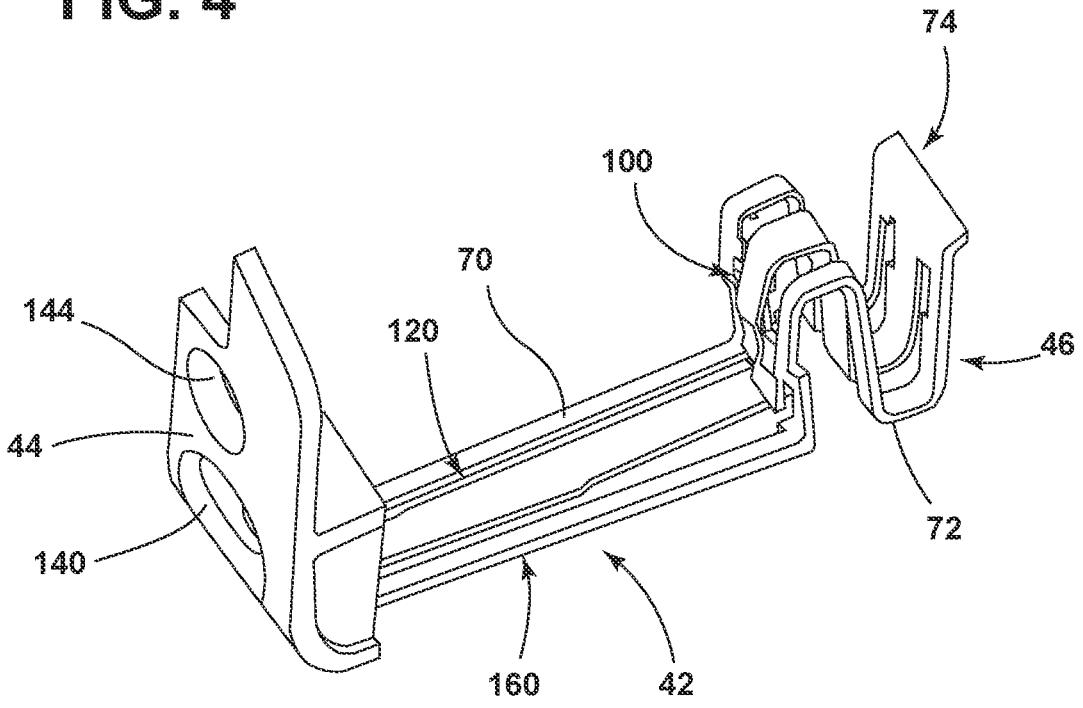
FIG. 5 is a perspective view of an aspect of the resilient retainer for a hinge assembly of an appliance.
Figure 6:
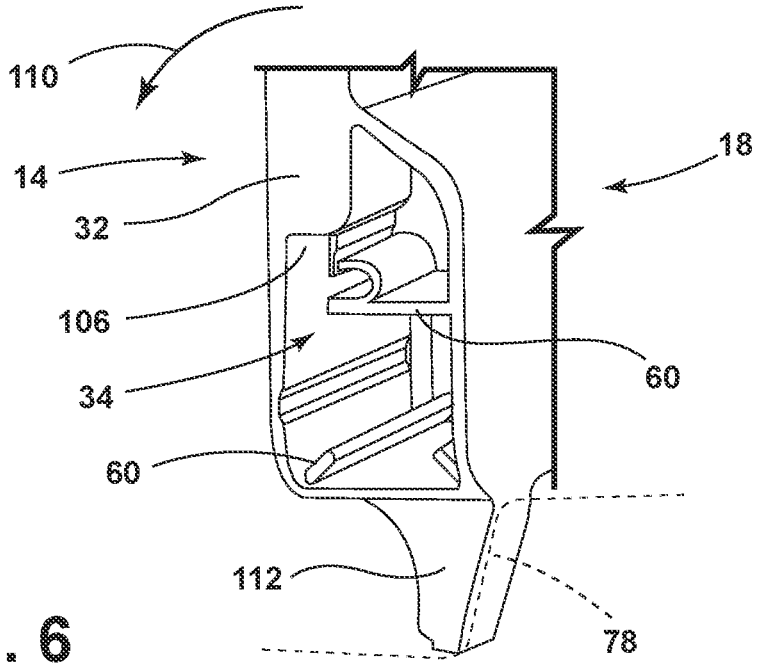
FIG. 6 is a partial side perspective view of an operable panel for an appliance and showing an aspect of the hinge housing.
Figure 7:
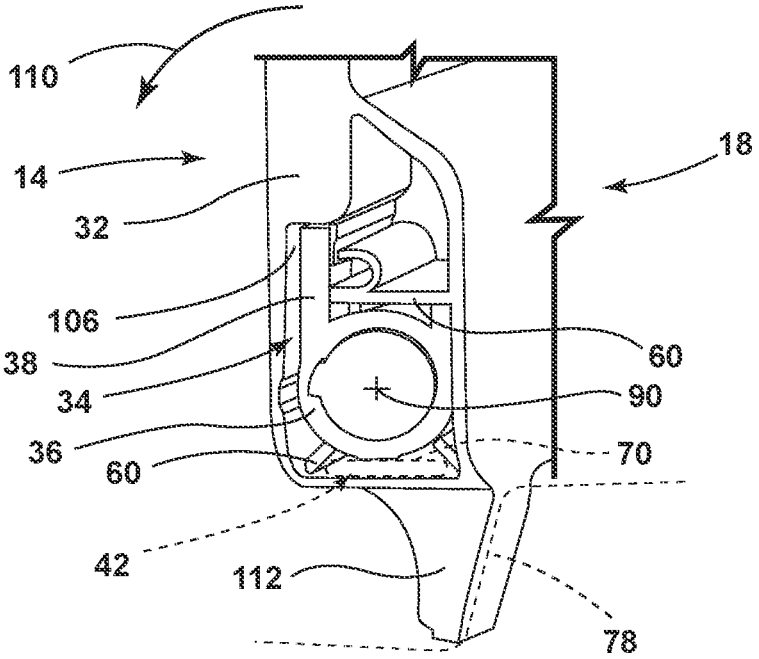
FIG. 7 is a side perspective view of the operable panel of FIG. 6 and showing the hinge installed therein and showing an installation space for receiving a resilient retainer.

As exemplified in FIGS. 4 and 5, the body 70 and the resilient portion 46 of the retainer 42 can include various slots 120 that can be utilized to calibrate the resilient construction of the retainer 42. The addition of the slots 120 within the body 70 and the resilient portion 46 can be used to modify the magnitude of the biasing force exerted in the outward direction 116. The biasing force in the outward direction 116 can be exerted by the retainer 42 onto the hinge member 36 for biasing the pin 40 toward an extended position 122 to engage the hinge receptacle 124 of the top panel 78 or other portion of the structural cabinet 16.

As exemplified in FIGS. 3-10, the resilient portion 46 of the retainer 42 can include various configurations of the undulating biasing formations 72. The resilient portion 46 can include as few as two undulating biasing formations 72 as well as up to four or more separate undulating biasing formations 72. The number of undulating biasing formations 72 can be determined by the depth of the hinge housing 34 and the width of the hinge member 36 that is contained within a hinge housing 34. The number of undulating biasing formations 72 and the width of the undulating biasing formations 72, can be utilized to occupy the compression space 130 defined between an end 132 of the hinge member 36, and a back wall 134 of the hinge housing 34. As discussed above, these undulating biasing formations 72 serve to manipulate the hinge member 36 between an extended state 74 and a compressed state 76 for installing the operable panel 14 onto the structural cabinet 16.

Referring again to FIGS. 1-10, the lid 32 for the appliance 12 typically includes a top panel 78 that defines a hinge receptacle 124 that receives a pin 40 for the hinge assembly 10. As discussed above, the lid 32 includes a hinge housing 34, and a hinge member 36 is disposed within the hinge housing 34 to extend between the lid 32 and the top panel 78. The retainer 42 includes a cap 44 and a resilient portion 46. The retainer 42 partially surrounds the hinge member 36 and the cap 44 encloses the hinge housing 34. The resilient portion 46 of the retainer 42 biases the hinge member 36 towards the cap 44 and the hinge receptacle 124. According to various aspects of the device, the cap 44 for the retainer 42 serves to enclose the hinge housing 34. The cap 44 can include a pin aperture 140, through which the pin 40 for the hinge member 36 can extend for engaging the hinge receptacle 124 of the top panel 78. The cap 44 can also include a fastener 142 that engages a portion of the operable panel 14, or a fastener aperture 144 that can cooperate with a separate fastener 142 for securing the cap 44 to the operable panel 14.

As exemplified in FIGS. 1-13, the cap 44 of the retainer 42 engages a first side 150 of the hinge member 36. The resilient portion 46 of the retainer 42 engages an opposing second side 152 of the hinge member 36. The retainer 42 includes the body 70 that extends between the cap 44 and the resilient portion 46. Typically, the body 70 engages a third side 154 of the hinge member 36. Through this engagement, the retainer 42 assists in rotationally securing the hinge member 36 within the hinge housing 34. This retainer 42 also serves to add strength and structural integrity to the operable panel 14 in the area of the hinge housing 34 during operation of the operable panel 14 between the open and closed positions 18, 20.

As discussed above, the resilient portion 46 of the retainer 42 can include the retaining feature 100 that secures the hinge member 36 against the body 70 and between the cap 44 and the resilient portion 46. Accordingly, during installation of the operable panel 14, the hinge assembly 10 can be inserted within the hinge housing 34 as a single assembly. Through this configuration, the retainer 42 defines a hinge securing receptacle 160 that is defined between the body 70, the cap 44 and the resilient portion 46 of the retainer 42. It is contemplated that the retaining feature 100 of the resilient portion 46 for the retainer 42 can engage a tab or other securing portion 102 of the hinge member 36 for securing the hinge member 36 within the retainer 42.

Figure 11:
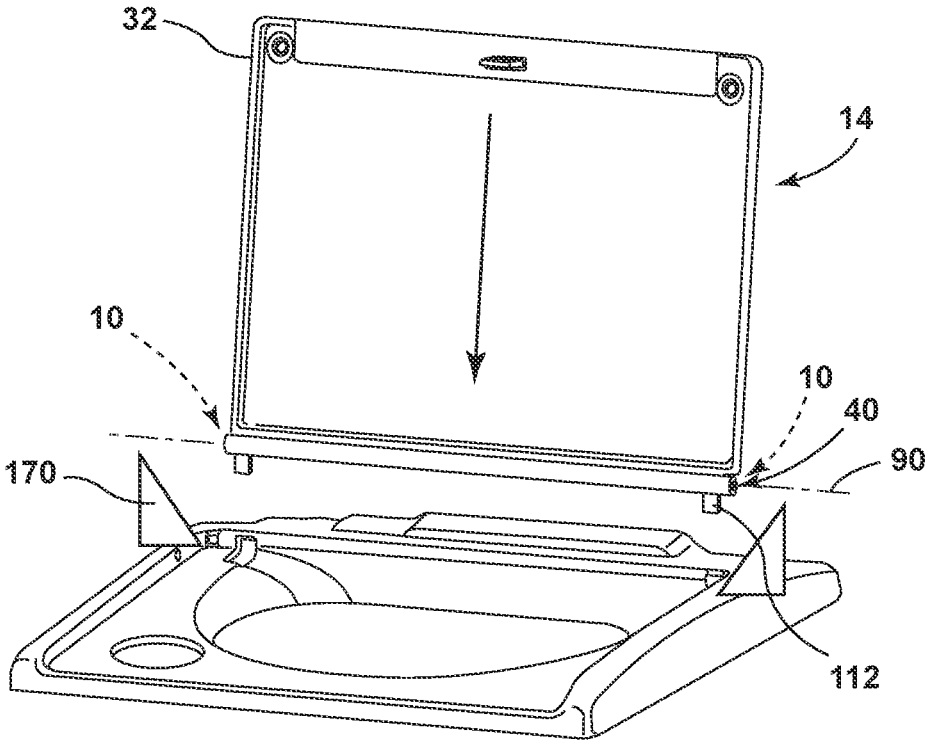
FIG. 11 is a schematic perspective view showing an installation of the operable panel onto a top panel for a laundry appliance.
Figure 12:
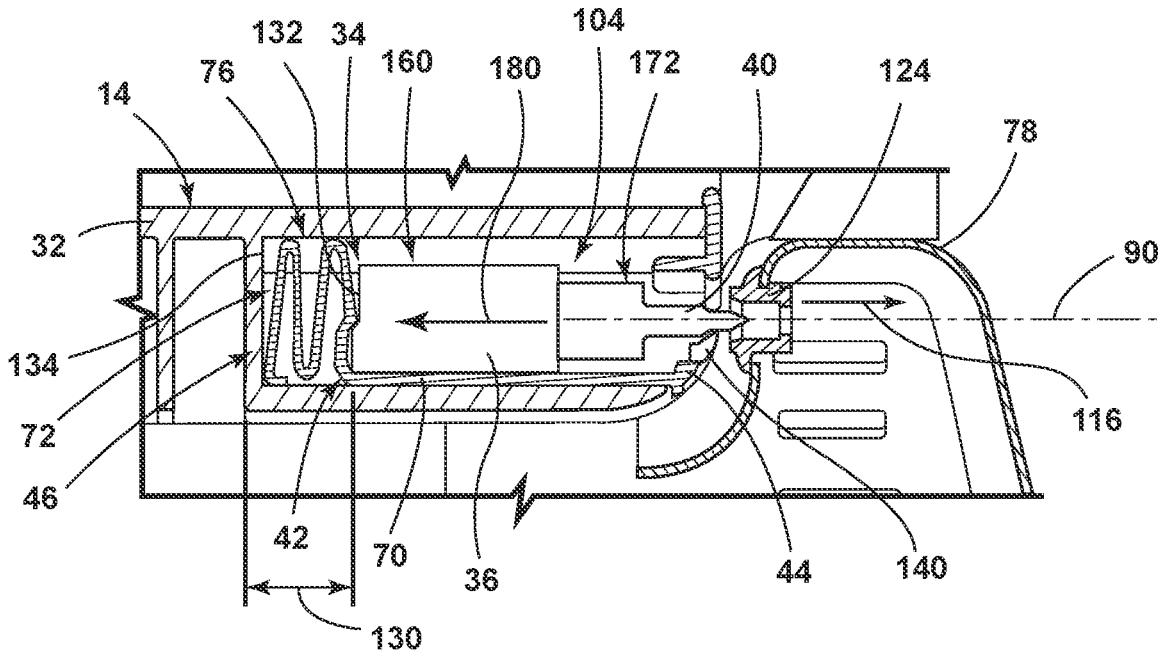
FIG. 12 is a cross-sectional view of the hinge assembly for the appliance and showing a process of installing the operable panel onto the top panel for the appliance.
Figure 13:
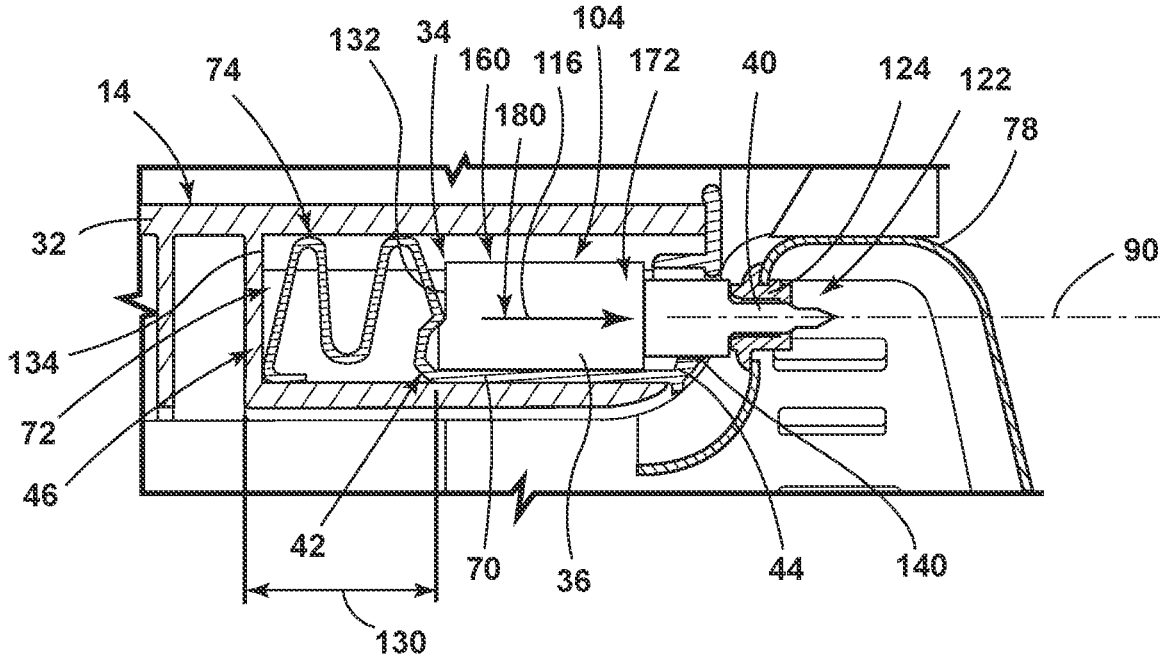
FIG. 13 is a cross-sectional view of the hinge assembly of FIG. 12 and showing the hinge assembly installed within the top panel for the appliance.

Referring now to FIGS. 11-13, during installation of the operable panel 14 within the structural cabinet 16, certain installation structures 170 can be coupled with the structural cabinet 16, and typically the top panel 78 for the structural cabinet 16. These installation structures 170 can serve to bias the pin 40 for the hinge assembly 10 to a retracted position 172. As discussed above, in the compressed state 76 of the resilient portion 46, the pin 40 and the remainder of hinge assembly 10 can pass by portions of the structural cabinet 16 to be installed within the hinge receptacles 124 for the top panel 78. These installation structures 170 engage the pin 40 and bias the pin 40, as well as the remainder of the hinge member 36, into the hinge housing 34. The resilient portion 46 of the retainer 42 operates to the compressed state 76 to allow for axial movement 180 of the hinge member 36 into the hinge housing 34. Because the retainer 42 and the hinge member 36 are rotationally secured within the hinge housing 34, the alignment of the flange 38 for the hinge member 36 remains in a proper position during installation of the lid 32 within the top panel 78. Through this orientation, the retainer 42 is rotationally secured within the hinge housing 34. The resilient portion 46, and the hinge member 36 are axially operable along a rotational axis 90 of the hinge member 36. Once the hinge member 36 is aligned with the hinge receptacles 124 of the top panel 78, the resilient portion 46 of the retainer 42 biases the pin 40 and the hinge member 36 in the outward direction 116 to secure one or both of the pins 40 for the opposing hinge assemblies 10 into the corresponding hinge receptacles 124.

Through this configuration of the retainer 42, hinge members 36 in the form of dampers 96 and lift-assist mechanisms 92 can be installed within the top panel 78 for the appliance 12 in a convenient process. It is contemplated that lift-assist mechanisms 92 can include interior springs that are calibrated at a very different biasing force as a damper 96 that may be installed within one of the two hinge assemblies 10. Accordingly, in a conventional installation process, it may be difficult to achieve a centrally aligned installation process where the operable panel 14 remains centrally positioned between the two opposing hinge receptacles 124 during installation of the operable panel 14 within the structural cabinet 16.

Utilizing the retainer 42 described herein, the resilient portion 46 of the retainer 42, which can be equally calibrated for each hinge assembly 10 of the opposing hinge assemblies 10, can be used to ensure a consistent centralized position of the operable panel 14 between the hinge receptacles 124 during installation of the operable panel 14 into the structural cabinet 16. Accordingly, the various biasing mechanisms and springs of the lift-assist mechanism 92 and the damper 96 are not typically utilized during installation of the operable panel 14 with the structural cabinet 16. Rather, the resilient portion 46 of the retainer 42 is utilized for the installation process so that a centralized position of the operable panel 14 can be achieved and maintained. Additionally, where the operable panel 14 may need to be separated from the structural cabinet 16, the resilient portion 46 of the retainer 42 can be conveniently biased to the compressed state 76 to allow for separation of the operable panel 14 with the structural cabinet 16 during maintenance or other servicing of the particular appliance 12.

Referring again to FIGS. 1-13, the hinge assembly 10 for the appliance 12 can include the hinge member 36 disposed within the hinge housing 34 of the operable panel 14. The retainer 42 includes the cap 44 that attaches to an outer aperture of the hinge housing 34 to enclose the hinge housing 34. The retainer 42 includes the resilient portion 46 that is integrally formed with each of the cap 44 and the body 70 extending between the cap 44 and the resilient portion 46. The cap 44 engages a first side 150 of the hinge member 36 and the resilient member engages an opposing second side 152 of the hinge member 36. The resilient portion 46 of the retainer 42 is typically at least partially compressed within the hinge housing 34 to bias the hinge member 36 toward the cap 44 and also toward the hinge receptacle 124 of the structural cabinet 16.

Utilizing the hinge assembly 10 described herein, the retainer 42, in combination with the hinge member 36, serves to provide a convenient installation mechanism for placing the various hinge assemblies 10 into the operable panel 14 for the appliance 12. Additionally, installation and removal for servicing are able to be conveniently accomplished through the incorporation of the retainer 42 having the resilient portion 46. As discussed above, the resilient portion 46 provides an outward biasing force that places the pin 40 in an engaging position with the hinge receptacle 124 for the structural cabinet 16. Utilizing the hinge assembly 10, the combination of the retainer 42 and the hinge member 36 serves to occupy the hinge housing 34 and provide strength and structural integrity to the operable panel 14 at the hinge housing 34 for receiving various operational stresses that can be received during operation of the operable panel 14 between the open and closed positions 18, 20.

According to another aspect of the present disclosure, an appliance includes a cabinet having an interior processing chamber. A lid is rotationally operable relative to the cabinet between open and closed positions. The lid includes a hinge housing. A hinge assembly extends between the lid and the cabinet. The hinge assembly includes a hinge member disposed within the hinge housing and having a flange that engages the lid. A pin extends outward from the hinge housing to engage the cabinet. A retainer occupies the hinge housing to rotationally secure the hinge member therein. The retainer includes a cap that encloses the hinge housing and also includes a resilient portion that biases the pin through the cap.

According to another aspect, the retainer includes a body that extends between the cap and the resilient portion.

According to another aspect of the present disclosure, the body, the cap and the resilient portion are formed as a single unitary piece.

According to another aspect, the resilient portion is defined by a plurality of undulating biasing formations.

According to yet another aspect, the resilient portion of the retainer is operable between an extended state and a compressed state. The compressed state is defined by the pin of the hinge member being substantially disposed within the retainer.

According to another aspect of the present disclosure, the resilient portion of the retainer includes a retaining feature that secures the hinge member against the body.

According to another aspect, the cap includes a fastener that secures the retainer and the hinge member within the hinge housing.

According to yet another aspect, the retainer is plastic.

According to another aspect of the present disclosure, an operable panel for an appliance includes a top panel that defines a hinge receptacle. A lid includes a hinge housing. A hinge is disposed within the hinge housing and extends between the lid and the top panel. A retainer includes a cap and a resilient portion. The retainer partially surrounds the hinge and the cap encloses the hinge housing. The resilient portion of the retainer biases the hinge toward the cap and the hinge receptacle.

According to another aspect, the hinge includes a pin that extends through the cap to engage the hinge receptacle of the top panel. The hinge includes a flange that partially secures the hinge within the hinge housing.

According to yet another aspect, the cap of the retainer engages a first side of the hinge. The resilient portion engages an opposing second side of the hinge. The retainer includes a body that extends between the cap and a resilient portion. The body engages a third side of the hinge.

According to another aspect of the present disclosure, the resilient portion and the cap are a single integral piece.

According to another aspect, the resilient portion is defined by a plurality of biasing undulating formations.

According to yet another aspect, the resilient portion of the retainer is operable between an extended state and a compressed state. The compressed state is defined by the pin of the hinge being substantially disposed within the retainer.

According to another aspect of the present disclosure, the resilient portion of the retainer includes a retaining feature that secures the hinge against the body. The cap includes a fastening portion that secures the retainer and the hinge within the hinge housing.

According to another aspect, the retainer is rotationally secured within the hinge housing and the resilient portion and the hinge are axially operable along a rotational axis of the hinge.

According to yet another aspect, a hinge assembly for an appliance includes a hinge disposed within a hinge housing of an operable panel. A retainer includes a cap that attaches to an outer aperture of the hinge housing to enclose the hinge housing. The retainer includes a resilient portion that is integrally formed with each of the cap and a body extending between the cap and the resilient portion. The cap engages a first side of the hinge and the resilient portion engages an opposing second side of the hinge. The resilient portion is compressed within the hinge housing and biasing the hinge toward the cap.

According to another aspect of the present disclosure, the body, the resilient portion and the cap are a single integral piece.

According to another aspect, the resilient portion is defined by a plurality of biasing undulating formations that are operable between an extended state and a compressed state. The compressed state is defined by a pin of the hinge being substantially disposed within the retainer.

According to yet another aspect, the retainer is rotationally secured within the hinge housing and the resilient portion and the hinge are axially operable along a rotational axis of the hinge.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A hinge assembly for an appliance, the hinge assembly comprising:

a hinge disposed within a hinge housing of an operable panel;

a retainer having a cap, a resilient portion and a body that extends between the cap and the resilient portion to form a single integral piece, wherein:

the cap attaches to an outer aperture of the hinge housing to enclose the hinge housing and engages a first side of the hinge;

the resilient portion engages an opposing second side of the hinge; and the resilient portion being compressed within the hinge housing and biasing the hinge toward the cap.

2. The hinge assembly of claim 1, wherein the resilient portion is defined by a plurality of biasing undulating formations that are operable between an extended state and a compressed state.

3. The hinge assembly of claim 2, wherein the compressed state is defined by a pin of the hinge being substantially disposed between the cap and the body of the retainer.

4. The hinge assembly of claim 1, wherein the retainer is rotationally secured within the hinge housing and the resilient portion and the hinge are axially operable along a rotational axis of the hinge.

5. The hinge assembly of claim 1, wherein the retainer axially positions the hinge within the hinge housing and also allows for rotational operation of the hinge during rotational motion of the operable panel.

6. The hinge assembly of claim 2, wherein the resilient portion of the retainer is operable between the extended state and the compressed state, wherein the compressed state is defined by a pin of the hinge being substantially disposed within the retainer.

7. The hinge assembly of claim 1, wherein the resilient portion of the retainer includes a retaining feature that secures the hinge against the body.

8. The hinge assembly of claim 1, wherein the cap includes a fastener that secures the retainer and the hinge within the hinge housing.

9. The hinge assembly of claim 1, wherein the retainer is plastic.

10. The hinge assembly of claim 1, wherein the retainer includes a plurality of slots that are defined within the body and the resilient portion.

11. The hinge assembly of claim 6, wherein the plurality of biasing undulating formations includes a retaining feature that maintains engagement with an end of the hinge in each of the extended state and the compressed state.

12. The hinge assembly of claim 11, wherein the retaining feature secures the hinge against the body of the retainer.

13. The hinge assembly of claim 12, wherein the hinge is configured to slidably engage the body as the plurality of biasing undulating formations operate between the extended state and the compressed state.

14. An appliance comprising:

a cabinet having an interior processing chamber;

an operable panel having a hinge housing and being rotationally operable relative to the cabinet between open and closed positions;

a hinge assembly extending between the operable panel and the cabinet, the hinge assembly comprising:

a hinge member disposed within the hinge housing and having a flange that engages the operable panel;

a pin that extends outward from the hinge housing to engage the cabinet; and a retainer that occupies the hinge housing to rotationally secure the hinge member therein, the retainer having a cap that encloses the hinge housing and also includes a resilient portion that biases the pin through the cap, wherein the retainer includes a body that extends between the cap and the resilient portion, a slot defined within the retainer, the slot extending through the retainer within the resilient portion and the body, wherein the cap, the body and the resilient portion form a single and integral piece.

15. The appliance of claim 14, wherein the resilient portion is defined by a plurality of undulating biasing formations and includes a retaining feature that maintains engagement of the hinge member with the body.

16. The appliance of claim 14, wherein the resilient portion of the retainer is operable between an extended state and a compressed state, wherein the compressed state is defined by the pin of the hinge member being substantially disposed within the retainer.

17. The appliance of claim 14, wherein the cap includes a fastener that secures the retainer and the hinge member within the hinge housing.

18. An operable panel for an appliance, the operable panel comprising:

a hinge housing;

a hinge disposed within the hinge housing and having a pin that selectively extends outward from the hinge housing;

a retainer having a cap and a plurality of biasing undulating formations, the retainer partially surrounding the hinge and the cap enclosing the hinge housing, wherein;

the plurality of biasing undulating formations bias the hinge toward the cap, the cap engaging a first side of the hinge and the plurality of biasing undulating formations engaging an opposing second side of the hinge;

the hinge includes the pin that is biased through the cap by the plurality of biasing undulating formations;

the hinge includes a flange that partially secures the hinge within the hinge housing; and the retainer includes a body that extends between the cap and the plurality of biasing undulating formations, the body engaging a third side of the hinge, wherein the cap, the body and the plurality of biasing undulating formations form a single and integral piece.

19. The operable panel of claim 18, wherein the plurality of biasing undulating formations of the retainer is operable between an extended state and a compressed state, wherein the compressed state is defined by the pin of the hinge being substantially disposed within the retainer.

* * * * *